US006408946B1

(12) United States Patent
Marshall et al.

(10) Patent No.: US 6,408,946 B1
(45) Date of Patent: Jun. 25, 2002

(54) MULTI-USE TUBING DISCONNECT

(75) Inventors: Gregory S. Marshall, Magnolia; Daniel R. Hart, Sugarland, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/561,484

(22) Filed: Apr. 28, 2000

(51) Int. Cl.[7] ..... E21B 23/04; E21B 34/10

(52) U.S. Cl. ..... 166/317; 166/242.1; 166/242.6; 166/376; 166/377

(58) Field of Search ..... 166/242.1, 242.6, 166/242.7, 317, 318, 376, 377, 378, 381

(56) References Cited

U.S. PATENT DOCUMENTS

| | | | | |
|---|---|---|---|---|
| 3,037,797 A | | 6/1962 | Brown | |
| 3,240,511 A | * | 3/1966 | Bishop et al. | 166/377 X |
| 3,646,996 A | * | 3/1972 | Pearce, Jr. | 166/217 X |
| 4,292,988 A | * | 10/1981 | Montgomery | 166/318 X |
| 4,452,472 A | | 6/1984 | Crase | |
| 4,671,361 A | | 6/1987 | Bolin | |
| 4,815,540 A | | 3/1989 | Wallbillich, III | |
| 4,949,793 A | * | 8/1990 | Rubbo et al. | 166/382 |
| 4,984,632 A | | 1/1991 | Sampa et al. | |
| 5,370,186 A | * | 12/1994 | Ireland | 166/377 X |
| 5,419,399 A | | 5/1995 | Smith | |
| 5,526,888 A | | 6/1996 | Gazewood | 175/320 |
| 5,695,009 A | * | 12/1997 | Hipp | 166/328 X |
| 5,787,982 A | | 8/1998 | Bakke | |
| 5,810,084 A | | 9/1998 | Echols | |
| 5,960,879 A | | 10/1999 | Echols | |
| 5,984,006 A | * | 11/1999 | Read et al. | 166/242.6 X |
| 5,988,287 A | * | 11/1999 | Jordan, Jr. et al. | 166/386 |
| 6,209,652 B1 | * | 4/2001 | Portman et al. | 166/379 |

FOREIGN PATENT DOCUMENTS

| | | |
|---|---|---|
| GB | A 2244736 | 12/1991 |
| GB | A 2310872 | 9/1997 |
| WO | A1 WO91/05935 | 5/1991 |

OTHER PUBLICATIONS

Baker Oil Tools Fishing Services Manual; pp. 86–87 (undated).

* cited by examiner

*Primary Examiner*—George Suchfield
(74) *Attorney, Agent, or Firm*—Gerald W. Spinks

(57) ABSTRACT

An apparatus for disconnecting a bottom hole assembly from a work string, having an upper tool body, a piston biased away from a slidable collet, locking dogs held in engagement with a lower tool body by the slidable collet, and one or more collet fingers holding the collet in place, relative to the upper body. The piston can be hydraulically displaced against the biasing spring, thereby releasing the collet finger, followed by further displacement of the piston to contact the collet, then displacement of the piston and the collet to release the locking dogs from engagement with the lower tool body. A shear pin in the collet can provide a positive pressure indication of release of the disconnect device.

25 Claims, 2 Drawing Sheets

MULTI-USE TUBING DISCONNECT

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This application is in the field of devices used in the oil well drilling industry, for releasably connecting one tubular element to another tubular element or piece of downhole equipment.

2. Background Art

In the drilling, completion, production, servicing, and workover of oil and gas wells, it is often necessary to disconnect the work string from a downhole tool, or from a lower section of work string. The downhole tool might include a fluid production device, a drill motor, or a drill bit, or any other bottom hole assembly which might be lowered into the well bore on a work string. Regardless of the type of downhole tool, selective disconnection from the work string may become necessary.

For instance, the bottom hole assembly in use may become stuck in the well bore to such an extent that it is impossible to remove from the well bore. In that case, the operator usually must selectively part the work string from the bottom hole assembly, and remove the work string from the well. Then, other tools can be run into the well bore for removal of the stuck bottom hole assembly. These other tools might be devices for grappling and pulling on the bottom hole assembly, or for jarring the bottom hole assembly loose, or even for milling the bottom hole assembly away.

It is helpful to have a tubular disconnect device in the work string at the desired disconnect location, to allow a positive and predictable release of the bottom hole assembly from the work string. The disconnect device should be impervious to the stresses and strains generated by the bottom hole assembly, and it should not be subject to inadvertent separation or loosening. The well bore environment also often includes the presence of varying amounts of debris, which is usually borne by the fluid being pumped down through the work string or up through the annulus surrounding the work string. A disconnect device should operate reliably despite the presences of such debris.

Various tubular disconnect devices have been developed over the years to achieve this disconnection of the work string from a downhole tool. Some such tools use locking dogs to lock the work string and the downhole tool together. Others may use a grappling device. In either case, the locking dogs or the grappling device are often held in the lock position by a movable piston, with the piston being held in place by a shear pin. After a ball is dropped through the work string, the piston can be displaced by the buildup of working fluid pressure, shearing the shear pin, with the piston being subsequently moved to a position where the locking dogs or the grappling device are no longer held in the lock position. This allows release of the bottom hole tool from the work string, usually by pulling on the work string. Often, in these tools, the bottom hole tool may generate, or be subject to, significant vibrations. These vibrations are often transmitted through the tool into the shear pin, causing it to fail prematurely, thereby inadvertently releasing the downhole tool from the work string.

Another tool which has been used as a tubular disconnect device utilizes a collet finger, or a plurality of fingers, to hold the tool to the work string. An upper tool body is locked to a lower tool body by a sliding collet, with the collet finger being held in a locking groove on the lower tool body by a contour on a lower extension of the upper tool body. The work string is pulled upwardly, raising the upper tool body against the force of a spring between the upper tool body and the collet. When the upper tool body has raised sufficiently, the collet finger is allowed to spring free of the groove in the lower tool body, thereby releasing the lower tool body from the upper tool body. This tool can be released only when the downhole tool is held in place with sufficient force to allow the necessary overpulling of the upper tool body to compress the spring.

Another known tool has a first set of collet fingers which lock the upper tool body to the lower tool body, with the collet fingers being held in the locked position by the lower skirt of an inner piston. The inner piston is held in attachment to the upper tool body by a spring and a second set of collet fingers. After a ball is dropped through the work string, pressure builds up above the inner piston until an outer piston is displaced upwardly by the same fluid pressure to further compress the spring. Upward displacement of the outer piston allows the second set of collet fingers to release the inner piston from the upper tool body, after which the inner piston is driven downwardly by fluid pressure to release the first set of collet fingers, thereby releasing the lower tool body from the upper tool body. The construction of this tool is complicated and expensive, and its proper function depends upon the spring to withstand the jarring load, to prevent the outer piston from displacing sufficiently to inadvertently release the lower body.

Still another known tool has a main piston which holds a set of locking dogs in place, to lock the upper tool body to the lower tool body, with the main piston being held in place by a ball and detent mechanism. A pilot piston holds the ball in the detent, preventing movement of the main piston, with the pilot piston being held in place by shear pins. Dropping of a ball through the work string and application of fluid pressure above the pilot piston shears the shear pins, allowing the pilot piston to release the ball from the detent, resulting in downward movement of the main piston to release the locking dogs. The jarring and impact of high frequency devices on the work string can impart repetitive impact to the shear pins, ultimately resulting in failure of the shear pins and inadvertent release of the tool. Further, the locking dogs of this tool are positioned in cavities that are open to drilling fluids; the particulates carried by the drilling fluid can pack the locking dog cavities sufficiently to immobilize the locking dogs.

BRIEF SUMMARY OF THE INVENTION

The present invention is a tubular disconnect device which has a collet held in place, relative to an upper body, by a set of outwardly biased collet fingers, or a shear pin and a set of collet fingers. The collet fingers are held in engagement with a groove by a movable piston, thereby preventing the application of any impact or force to the shear pin, where present. The collet holds a set of locking dogs in place, locking the upper body and a lower body together. The piston is biased upwardly away from the collet by a spring. Dropping of a ball through the work string allows application of fluid pressure above the piston, thereby compressing the spring. After sufficient compression of the spring and downward movement of the piston, the collet fingers are released, and the piston abuts the collet. Continued application of fluid pressure pulls the collet fingers out of their groove, and forces the collet downwardly, thereby freeing the locking dogs from engagement with the lower body, releasing the tool.

The collet can be sealed against the tool body to prevent contamination of the dog cavities with particulates in the drilling fluid. An adjustment sleeve can be provided to establish a rigid connection holding all the major body components in place, to prevent displacement during jarring operations. Where the shear pin is present, it maintains the collet in position after release of the collet fingers, until a higher fluid pressure shears the pin, giving the operator a positive indication that release of the tool has been achieved. However, the collet is actually held in place by the collet fingers, preventing application of impact to the shear pin. Since the collet fingers can not be released until the piston contacts the collet, the tool is highly resistant to inadvertent release.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
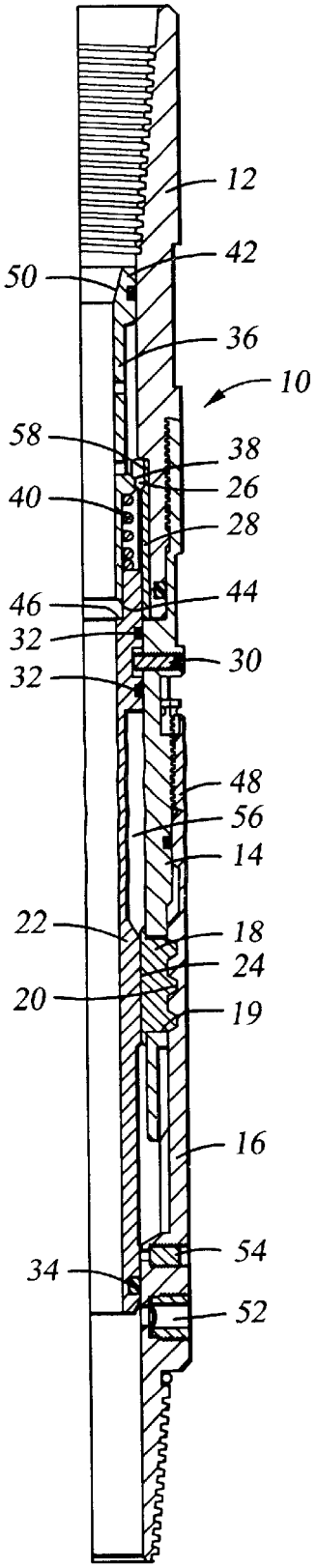
FIG. 1 is a longitudinal section of the apparatus of the present invention, in the run-in configuration.

FIG. 1 shows a longitudinal section view of the disconnect device 10 of the present invention, in which a generally cylindrical upper tool body 12 has an upper end provided with threads for attaching the disconnect device 10 to a work string (not shown). The upper tool body 12 has a lower end which is threadedly engaged with the upper end of a generally cylindrical dog housing 14, which in turn has a lower end which is slidably engaged with the upper end of a generally cylindrical lower body 16. The terms "upper" and "lower" are used herein to mean essentially "uphole" and "downhole", respectively. The disconnect device 10 can be used in a horizontal well bore, as well as a vertical well bore. The slidable engagement of the dog housing 14 with the lower body 16 can be by means of splines and grooves, as shown, to provide torsional strength. The lower end of the lower body 16 is provided with threads for attaching the disconnect device 10 to a bottom hole assembly or other downhole tool (not shown).

A transversely movable locking dog 18 is carried in a dog slot 19 in the dog housing 14. The locking dog 18 is shown engaged with a dog cavity 20 on the interior surface of the lower body 16, thereby longitudinally locking the dog housing 14 to the lower body 16. The locking dog 18 is held in forcible engagement with the dog cavity by abutment with a raised contour 24 on the exterior surface of a generally cylindrical slidable collet 22. One or more collet fingers 26 extend upwardly from the upper end of the collet 22. A generally cylindrical collet sleeve 28 surrounds the upper end of the collet 22 and the collet fingers 26. The upper end of the collet sleeve 28 abuts a shoulder on the upper body 12, and the lower end of the collet sleeve 28 abuts a shoulder on the dog housing 14, to hold the collet sleeve 28 longitudinally in place.

The upper end of each collet finger 26 has an outward projection which engages a recess 58 on the interior surface of the collet sleeve 28. The collet fingers 26 can be outwardly biased to ensure that the fingers 26 engage the recess 58. Forcible engagement of the collet fingers 26 with the recess 58 in the collet sleeve 28 provides the primary means of longitudinally capturing the collet 22 in place relative to the upper body 12, thereby longitudinally capturing the collet 22 in place relative to the dog housing 14. One or more shear pins 30 can be provided to pin the collet 22 to the dog housing 14. Where provided, the shear pins 30 function as means of informing the operator that release of the tool has been achieved, as will be explained further below. Upper collet seals 32 and one or more lower collet seals 34 seal the annular cavity 56 between the collet 22 and the dog housing 14 and lower body 16 against contamination by drilling fluid, which may be laden with particulates.

A generally cylindrical slidable piston 36 is positioned within the upper body 12, generally above the collet 22. The slidable piston 36 is shown in its initial position, or run-in Q position, in FIG. 1. The piston 36 has an outward projection 38 which abuts the upper ends of the collet fingers 26, to hold the collet fingers 26 in forcible engagement with the recess 58 in the collet sleeve 28, when the piston 36 is in its initial position. In the condition shown in FIG. 1, the internal bore of the piston 36 is open, allowing the flow of fluids through the piston 36, and on through the internal bore of the remainder of the disconnect device 10. A spring 40 is positioned between the piston 36 and the upper end of the collet 22, to bias the piston 36 upwardly. This initial position of the piston 36 is also its uppermost position, since the outward projection 38 abuts an internal shoulder on the upper end of the collet finger 26. Further, in this initial position, the lower end 44 of the piston 36 is vertically spaced apart from an internal shoulder 46 on the collet 22. The upper end 42 of the piston 36 has an internal seat 50 for receiving a ball to be dropped through the work string, as will be explained below.

An adjustment sleeve 48 on the exterior of the disconnect device 10 is threadedly engaged with the exterior surface of the dog housing 14. The lower end of the adjustment sleeve 48 abuts the upper end of the lower body 16. When the adjustment sleeve 48 is threaded in the downward direction, it applies downward force against the lower body 16 and upward force against the dog housing 14. The lower body 16 in turn applies downward pressure against the dog 18, which then reacts downwardly against the dog slot 19 in the dog housing 14. Therefore, it can be seen that adjustment of the adjustment sleeve 48 will apply a desired tension to the dog housing 14, to remove any looseness or slack in the assembled dog housing 14 and lower body 16. The dog housing 14 is itself threaded to the upper body 12, so there is no looseness in the major body components of the disconnect device 10, thereby minimizing the impact which can be imparted to the collet fingers 26 and the shear pin 30.

An overpressure device 52, such as a rupture disk, is provided between the internal bore of the lower body 16 and the annular space surrounding the lower body 16, below the collet 22. This allows the operator to overpressurize the internal bore to establish a flow path to the annulus. A fluid bypass device 54, such as a weep valve, is provided between the internal bore of the lower body 16 and the annular space surrounding the lower body 16, above the lower seal 34 in the lower end of the collet 22. An enlarged internal diameter in the lower body 16 can be provided adjacent the weep valve 54 to place the weep valve 54 in fluid flow communication with the annular space 56, between the collet 22 and the dog housing 14 and the lower body 16, as shown. The weep valve 54 prevents the annular space 56 from overpressurizing and locking the tool against release.

Figure 2:
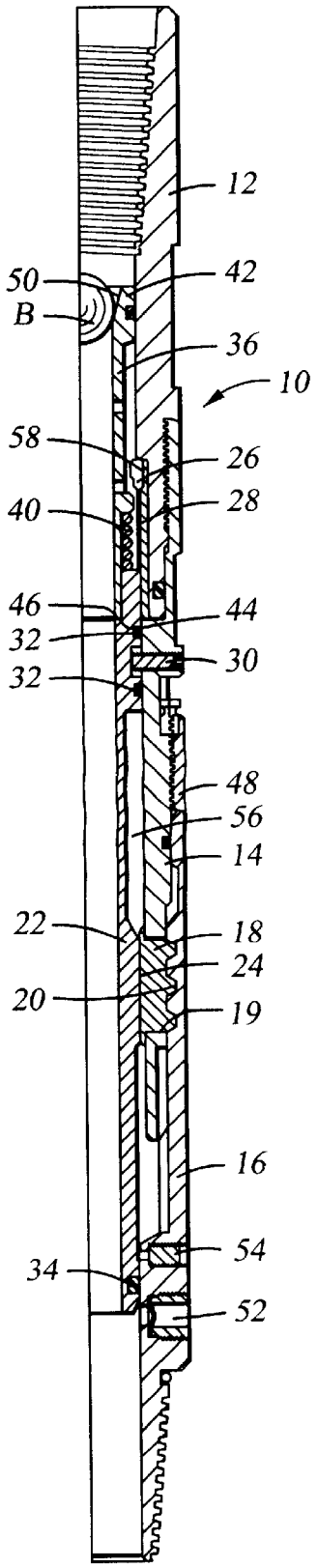
FIG. 2 is a longitudinal section of the apparatus of the present invention, showing initial displacement of the piston to abut the collet, and release of the collet finger.

As seen in FIG. 2, when it is desired to release the disconnect device 10, a ball B is dropped through the work string to seat on the seat 50 at the upper end 42 of the piston 36. Fluid being pumped through the work string then builds pressure above the piston 36, driving the piston 36 downwardly and compressing the spring 40 until the lower end 44 of the piston 36 abuts the shoulder 46 on the collet 22. It can be seen that, at this position of the piston 36, the outward projection 38 on the piston 36 has moved downwardly away from its abutment with the upper end of the collet finger 26, thereby releasing the collet finger 26 to be pulled out of engagement with the recess 58 in the collet sleeve 28. Therefore, at this point, the collet 22 is no longer captured or locked longitudinally relative to the upper body 12 and the dog housing 14.

Figure 3:
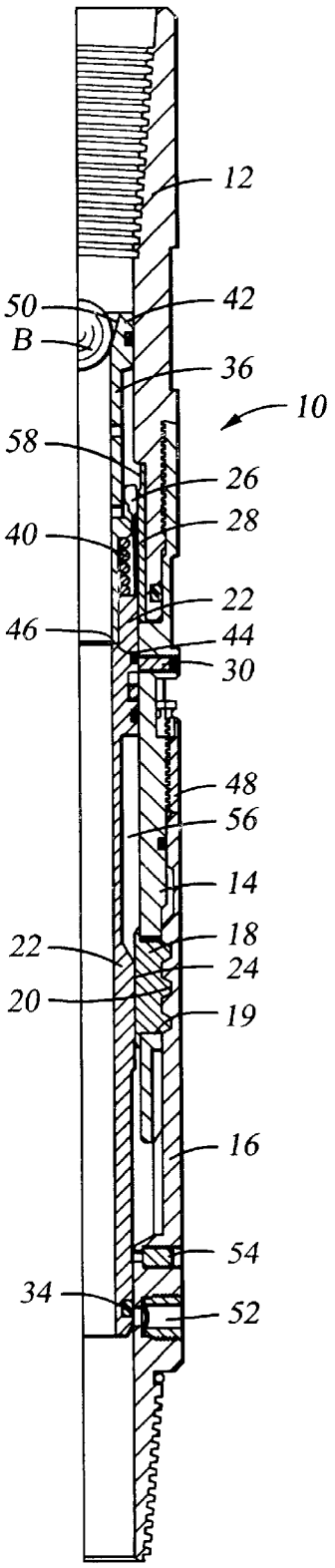
FIG. 3 is a longitudinal section of the apparatus of the present invention, showing initial displacement of the collet, to pull the collet finger out of its groove and to shear the shear pin.

As seen in FIG. 3, as the piston 36 is driven further downwardly by hydraulic pressure, abutment of the piston 36 with the collet 22 drives the collet 22 downwardly, pulling the upper ends of the collet fingers 26 out of the recess 58 in the collet sleeve 28. Recall that the collet fingers 26 were released to be pulled out of the recess 58 by the initial downward movement of the piston 36, described above. The weep valve 54 allows fluid to escape the annular space 56 as the collet 22 moves downwardly. Simultaneously, the shear pin 30, when present, is sheared, to give the operator a noticable pressure drop to provide positive indication that the collet 22 has moved downwardly.

Figure 4:
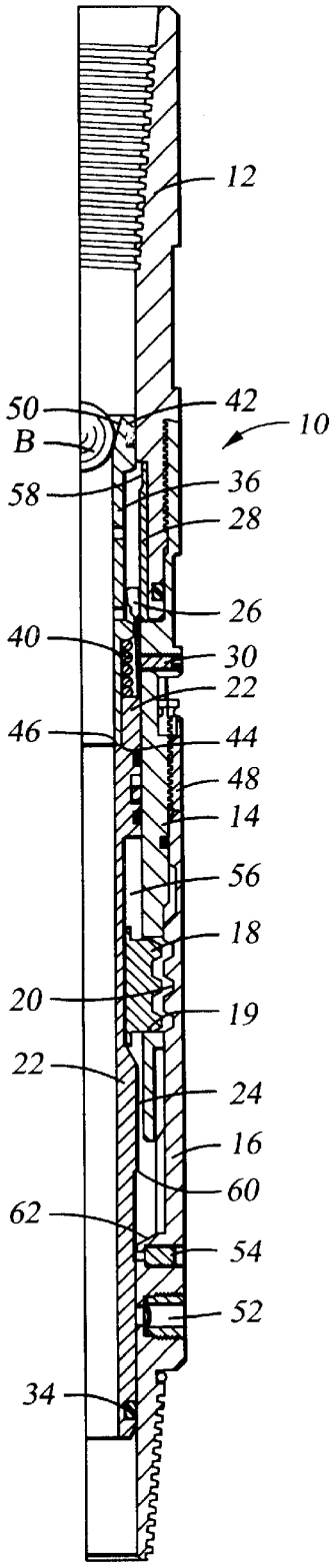
FIG. 4 is a longitudinal section of the apparatus of the present invention, showing further displacement of the collet, to release the locking dog from the dog cavity.

As the piston 36 and the collet 22 continue to be driven downwardly by hydraulic pressure, as shown in FIG. 4, the raised external contour 24 on the collet 22 moves below the dog 18. This releases the dog 18 from forcible engagement with the dog cavity 20 in the lower body 16. Downward movement of the piston 36 and the collet 22 can continue until an external shoulder 60 on the collet 22 abuts an internal shoulder 62 on the lower body 16, or until the collet 22 abuts the upper end of the dog 18. Once the dog 18 has been released from forcible engagement with the dog cavity 20 in the lower body 16, the upper body 12 and the dog housing 14 are free to move longitudinally relative to the lower body 16. Therefore, the work string, the upper body 12, the dog housing 14, the collet 22, and the piston 36 can be pulled out of the well bore, leaving the lower body 16 and any equipment attached therebelow in the well. The lower body 16 can be provided with a grappling contour, as shown, to facilitate its removal from the well bore with a grapple.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A disconnect device for downhole use in oil or gas wells, comprising:

an upper tool body;

a dog housing mountable to said upper body;

a lower tool body;

at least one movable dog cried by said dog housing;

a collet adapted to selectively maintain said at least one dog in engagement with said lower body, thereby preventing longitudinal movement of said lower body relative to said dog housing; and a piston slidably mounted at an initial position relative to said dog housing, wherein said piston is not in abutment with said collet, wherein said piston is hydraulically movable from said initial position to a second position in which said piston abuts said collet to move said collet longitudinally relative to said dog housing to release said at least one dog from engagement with said lower body.

2. The disconnect device recited in claim 1, further comprising at least one shear pin attaching said collet to said dog housing, wherein said piston moves said collet longitudinally to shear said at least one shear pin and then to release said at least one dog from engagement with said lower body.

3. The disconnect device recited in claim 1, further comprising a capture element on said collet for longitudinally capturing said collet relative to said dog housing to maintain said at least one dog in engagement with said lower body.

4. The disconnect device recited in claim 3, wherein:

said capture element comprises a finger on said collet;

said piston is adapted to hold said collet finger longitudinally stationary relative to said upper body in said initial position of said piston; and said piston is adapted to release said collet finger upon movement of said piston from said initial position.

5. The disconnect device recited in claim 1, further comprising at least one dog cavity on said lower body for receiving said at least one dog, to prevent relative longitudinal motion between said dog housing and said lower body.

6. The disconnect device recited in claim 1, further comprising a biasing device adapted to bias said piston away from said collet.

7. The disconnect device recited in claim 6, wherein said biasing device comprises a spring arranged between said piston and said collet.

8. A disconnect device for downhole use in oil or gas wells, comprising:

an upper tool body;

a dog housing mountable to said upper body;

a lower tool body;

at least one movable dog carried by said dog housing;

a collet adapted to selectively maintain said at least one dog in engagement with said lower body, thereby preventing longitudinal movement of said lower body relative to said dog housing;

at least one shear pin attaching said collet to said dog housing; and a piston slidably mounted at an initial position relative to said dog housing, wherein said piston is not in abutment with said collet;

wherein said piston is hydraulically movable from said initial position to a second position in which said piston abuts said collet to shear said at least one shear pin, and to then move said collet longitudinally relative to said dog housing to release said at least one dog from engagement with said lower body.

9. The disconnect device recited in claim 8, further comprising a capture element on said collet for longitudinally capturing said collet relative to said dog housing, preventing inadvertent application of shear force to said at least one shear pin.

10. The disconnect device recited in claim 9, wherein:

said capture element comprises a finger on said collet;

said piston is adapted to hold said collet finger longitudinally stationary relative to said upper body in said initial position of said piston; and said piston is adapted to release said collet finger upon movement of said piston from said initial position.

11. The disconnect device recited in claim 8, further comprising at least one dog cavity on said lower body for receiving said at least one dog, to prevent relative longitudinal motion between said dog housing and said lower body.

12. The disconnect device recited in claim 8, further comprising a biasing device adapted to bias said piston away from said collet.

13. The disconnect device recited in claim 12, wherein said biasing device comprises a spring arranged between said piston and said collet.

14. The disconnect device recited in claim 8, further comprising a seat on said piston, said seat being adapted to receive a setting ball to increase hydraulic force on said piston.

15. The disconnect device recited in claim 8, further comprising at least one seal adapted to prevent flow of working fluid past said dog.

16. The disconnect device recited in claim 15, wherein said seal is adapted to prevent flow of working fluid between said dog housing and said collet.

17. The disconnect device recited in claim 16, further comprising a fluid bypass device adapted to relieve fluid pressure between said dog housing and said collet, thereby allowing movement of said collet relative to said dog housing.

18. The disconnect device recited in claim 17, wherein said fluid bypass device comprises a weep valve.

19. The disconnect device recited in claim 8, further comprising an overpressure device adapted to selectively establish flow between the interior of said disconnect device and a well bore annulus surrounding said disconnect device.

20. The disconnect device recited in claim 19, wherein said overpressure device comprises a rupture disk.

21. The disconnect device recited in claim 8, further comprising an adjusting sleeve adapted to bias said lower body away from said dog housing, to prevent loose assembly points.

22. The disconnect device recited in claim 21, wherein:

said adjusting sleeve threadedly engages one of said dog housing and said lower body; and said adjusting sleeve abuts the other of said dog housing and said lower body.

23. A disconnect device for downhole use in oil or gas wells, comprising:

an upper tool body;

a locking device mountable to said upper body;

a lower tool body;

a collet adapted to selectively maintain said locking device in engagement with said lower body, thereby preventing longitudinal movement of said lower body relative to said upper body;

at least one shear pin preventing longitudinal movement of said collet relative to said upper body;

a capture element on said collet for longitudinally capturing said collet relative to said upper body, preventing inadvertent application of shear force to said at least one shear pin; and a piston slidably mounted at an initial position relative to said upper body, wherein said piston is not in abutment with said collet;

wherein said piston is hydraulically movable from said initial position to a second position in which said piston abuts said collet to shear said at least one shear pin, and to then move said collet longitudinally relative to said upper body to release said locking device from engagement with said lower body.

24. The disconnect device recited in claim 23, further comprising a biasing device adapted to bias said piston away from said collet.

25. The disconnect device recited in claim 24, wherein said biasing device comprises a spring arranged between said piston and said collet.

* * * * *